United States Patent [19]

Vernerey et al.

[11] 3,993,391

[45] Nov. 23, 1976

[54] ELECTRICAL CONTACT FOR STRIPLESS CABLE CONNECTIONS

[75] Inventors: Jean-Claude Vernerey; Roman J. Komorowski; Gilles F. A. Tournier, all of Colomiers, France

[73] Assignee: ITT Industries, Inc., New York, N.Y.

[22] Filed: Sept. 19, 1975

[21] Appl. No.: 614,839

[52] U.S. Cl. ..... 339/97 R; 339/223 R

[51] Int. Cl.[2] ..... H01R 11/20

[58] Field of Search ..... 339/95, 97–99, 339/217, 223

[56] References Cited

UNITED STATES PATENTS

| | | | |
|---|---|---|---|
| 3,162,501 | 12/1964 | Wahl | 339/98 |
| 3,320,354 | 5/1967 | Marley et al. | 339/98 |
| 3,404,368 | 10/1968 | Roberts et al. | 339/223 S |
| 3,767,841 | 10/1973 | Anderson et al. | 339/97 C |
| 3,902,154 | 8/1975 | McKee | 339/223 R |
| 3,926,498 | 12/1975 | Hoppe, Jr. | 339/97 R |

*Primary Examiner*—Joseph H. McGlynn
*Attorney, Agent, or Firm*—Thomas J. Peterson

[57] ABSTRACT

An electrical contact for stripless cable connections comprising a front contacting part and a rear channel-shaped part of U-shaped cross-section. A fork is cut off from the base of a channel-shaped rear part of the contact and bent upwardly at right angles between the lateral walls of the channel. The branches of the fork define insulation severing, core penetrating jaws. The lateral walls of the channel prevent spreading of the jaws when a cable is forced therebetween to be electrically connected to the contact. A rearwardly extending contact retention tongue is also formed in the base where the fork is cut therefrom and is bent outwardly for engagement with a shoulder in an insulator in which the contact is mounted.

3 Claims, 4 Drawing Figures

ELECTRICAL CONTACT FOR STRIPLESS CABLE CONNECTIONS

BACKGROUND OF THE INVENTION

The present invention relates generally to an electrical contact and, more particularly, to an electrical contact for stripless cable connections.

For the connection of cables to electrical contacts very often soldering and crimping operations are necessary or screws are used. All these methods necessitate the prior stripping of the insulation sheath from the metallic core of the cable which is time-consuming and requires special tools. As a result, the cost of terminating contacts to a large number of cables may be relatively high. This is particularly in the case in the telecommunication field in which extremely great numbers of electrical connections to cables must be made. There is therefore a substantial need for minimizing the connection process, that is, to reduce it to the mere insertion of the cable into its contact, preferably without stripping the cable during the insertion process.

For this purpose, there already exists a number of devices which permit a connection to an electrical contact without stripping the insulation sheath from the core of the cable. For example, the cable may be inserted between opposed jaws of a connection device which severes the insulation sheath and penetrates the core of the cable as it is forced between the jaws. However, in such devices the jaws tend to spread apart when the cable is forced therebetween which reduces the reliability of the electrical connection which is made.

It is the object of the present invention to overcome the aforementioned disadvantage of present stripless cable connection devices, which is also simple and economical.

SUMMARY OF THE INVENTION

According to the principal aspect of the present invention, there is provided an electrical contact for making electrical connection to a cable core without stripping the insulation sheath from the core. The contact comprises a front contacting part and a rear channel part having a generally U-shaped cross-section. The channel-shaped rear part of the contact includes a generally flat base and a pair of lateral walls. A stripless cable connection means is provided in the rear part of the contact. Such means comprises a fork which is cut from the base and bent upwardly therefrom between the lateral walls of the contact. The fork includes a pair of spaced branches defining opposed insulation severing-core penetrating jaws. When a cable is forced between the jaws to make electrical connection between the cable and the contact, the walls on the rear of the contact prevent the jaws from spreading apart, thereby enhancing the reliability and quality of the electrical connection which is established.

According to another aspect of the present invention, an outwardly bent rearwardly extending contact retention tongue is cut from the rear base of the contact. The tongue has a configuration complementary to the opening defined between the branches of the fork which forms the cable connection means. The tongue lies within such opening prior to bending the fork upwardly from the base of the contact. By this construction, the tongue and fork may be formed by a single cutting operation, and by bending the two parts to their respective positions. The tongue cooperates with a shoulder in the insulator in which the contact is mounted to prevent rearward withdrawal of the contact from the insulator. It is well known in the art that the tongue may be released by the use of a suitable tool inserted from the front of the insulator into the contact receiving cavity in order to allow the contact to be removed rearwardly from the insulator.

DESCRIPTION OF THE PREFERRED EMBODIMENTS

Figure 1:
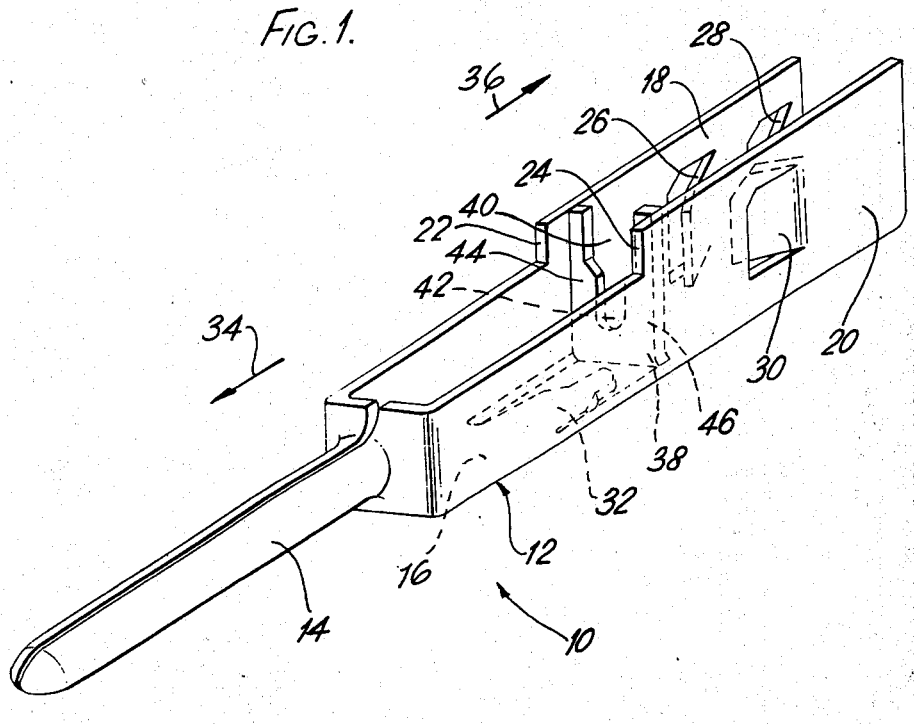
FIG. 1 is an enlarged perspective view of one form of the contact of the present invention.
Figure 2:
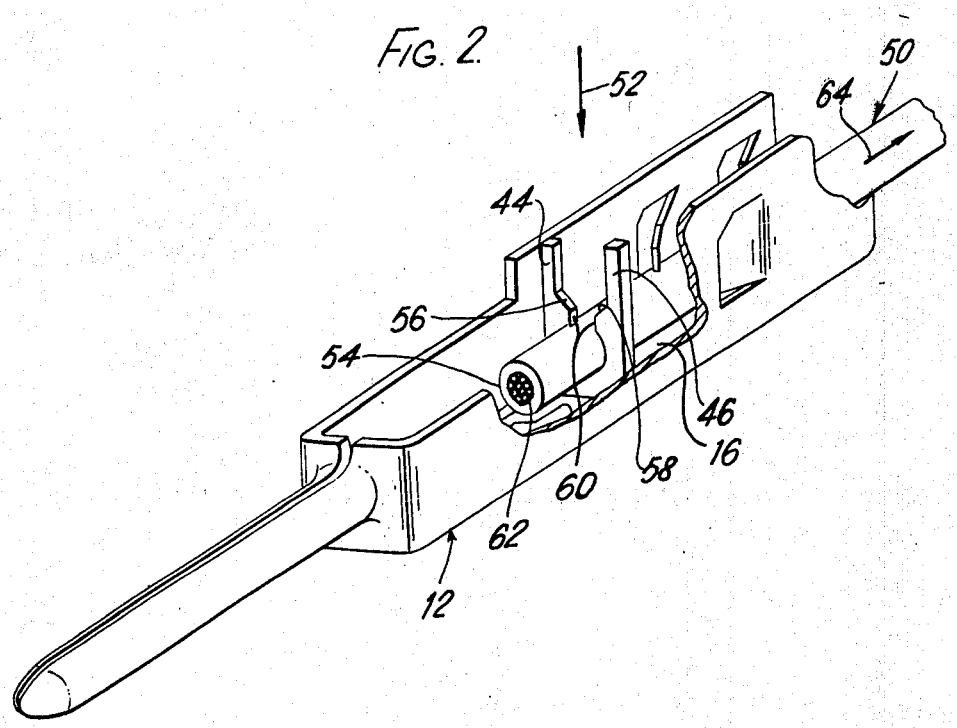
FIG. 2, is a perspective view similar to FIG. 1 showing a cable terminated to the contact, with a portion of the wall of the contact removed to show how the cable is connected to the contact.

Referring now to FIGS. 1 and 2 in detail, there is illustrated one embodiment of the contact of the present invention, generally designated 10. The contact has a rear cable termination part 12 and a front contacting part 14. The contact is of one piece integral construction, and is stamped from a flat sheet of metal and formed to the desired configuration as illustrated in the drawing and as will be described hereinafter. The front contacting part 14 of the contact is illustrated as being a male element having the configuration of a pin. It will be appreciated however that the front part 14 could have any other shape. For example, the front part could have a hollow cylindrical configuration to provide a female contact element. The rear part 12 would retain the same configuration as illustrated in FIG. 1.

During the manufacture of the contact 10, its rear part is folded so that it finally provides a channel configuration having a general U-shaped cross-section providing a flat base 16 and lateral walls 18 and 20 which are parallel to each other and disposed at right angles with respect to the base. It will be noted that the height of the lateral walls 18 and 20 is not identical through the length of the walls. The front part of the walls is lower to provide forwardly facing vertical shoulder 22 and 24 which function as a stop for the contact when it is inserted into a contact cavity in a connector insulator, not shown.

Forwardly extending tongues 26, 28 and 30 are cut out of the lateral walls 18 and 20 and are bent inwardly into the channel-shaped rear part of the contact. Another tongue 32 is formed in the base 16 of the rear part 12 of the contact. The tongue 32 extends rearwardly and is bent downwardly from the base to provide a resilient contact retention finger which retains the contact in its connector insulator after insertion thereinto. As well known in the art, when the contact is inserted forwardly into the connector insulator, that is, in the direction of arrow 34 in FIG. 1, the resilient retention finger 32 moves into the base 16 of the contact. After the insertion of the contact, the finger 32 returns to its external position with respect to the base 16 and its free end abuts a shoulder in the connector insulator so that the contact is locked in the insulator since it is impossible to move it rearwardly in the direction of the arrow 36.

It is to be noted that the contact retention tongue or finger 32 results from a cutting process formed in the base 16 of the rear channel-shaped part 12 of the contact. The cutting process forming the tongue 32 takes place along the internal width of the channel and along the lateral walls 18 and 20. The cut material is not removed but rather remains integral with the base 16 and is folded upwardly at a right angle to provide a vertical fork 38 which serves as the means for the contact for making a stripless electrical connection to a cable. Thus, it will be appreciated that an important feature of the invention is that the cable termination fork 38 is obtained simultaneously with the retention tongue 32 by a single and same cutting process. The fork has a generally U-shaped internal cut or opening corresponding to the tongue 32. This opening includes a larger U part 40 toward the outside of the fork 38 and a smaller U part 42 toward the base 16 of the channel for reasons which will become apparent in connection with the description of FIG. 2. It will be noted that by the cut of the fork 32 from the base 16 in the manner just described, when the fork is bent vertically between the lateral walls 18 and 20 of the channel shaped part of the contact, the branches 44 and 46 of the fork contact the internal face of the walls.

Reference is now made to FIG. 2 of the drawings which illustrates a cable 50 inserted into the channel-shaped rear part 12 of the contact. Part of the wall 20 has been cut away in order to see the interior of the rear part of the contact, and how the cable 50 is terminated thereto. The cable is inserted downwardly in the direction of the arrow 52 between the branches 44 and 46 of the fork 38. The distance between the upper parts of the branchss 44 and 46 defining the larger opening 40 of the fork is greater than the external diameter of the cable 50. The upper part of the branches therefore provide a guide for the cable. As the cable introduction continues in the direction of the arrow 52 its insulation sheath 54 encounters flanks 56 and 58 which taper inwardly to the opposed insulation severing-core penetrating jaws 60 of the branches 44 and 46 defined by the smaller lower portion 42 of the fork. The flanks 56 and 58 progressiely engage the cable as the cable is inserted into the lower part of the branches of the fork. The distance between the jaws 60 is slightly less than the diameter of the core 62 of the cable 50. Thus, as the cable is forced downwardly into the opening 52 the jaws 60 will sever through the insulation sheath 54 and bite into or penetrate the metal core 62 of the cable thereby providing electrical connection between the cable and the contact.

It will be appreciated that when the cable 50 is forced downwardly between the branches 44 and 46 of the fork 38 to engage the jaws 60 thereon, the branches will tend to spread apart. However, the outer edges of the branches engage the lateral walls 18 and 20 of the channel-shaped rear part of the contact, thereby preventing the branches from spreading apart. This arrangement thereby greatly enhances the reliability and quality of the electrical connection made between the cable 50 and the contact of the present invention.

It is noted that because the tongues 26, 28 and 30 extend forwardly and are bent inwardly into the channel-shaped rear part of the contact, they bite into the cable insulation sheath 54 with sharp fork edges without touching the metallic core of the cable. These tongues insure the retention of the cable in its position and prevent its withdrawal from the contact by biting the insulation sheath more and more deeply if efforts are made to pull the cable rearwardly from the contact in the direction of the arrow 64 in FIG. 2. Thus, the tongues 26, 28 and 30 provide a strain relief arrangement for the cable behind the point where the cable is electrically connected to the contact.

Figure 3:
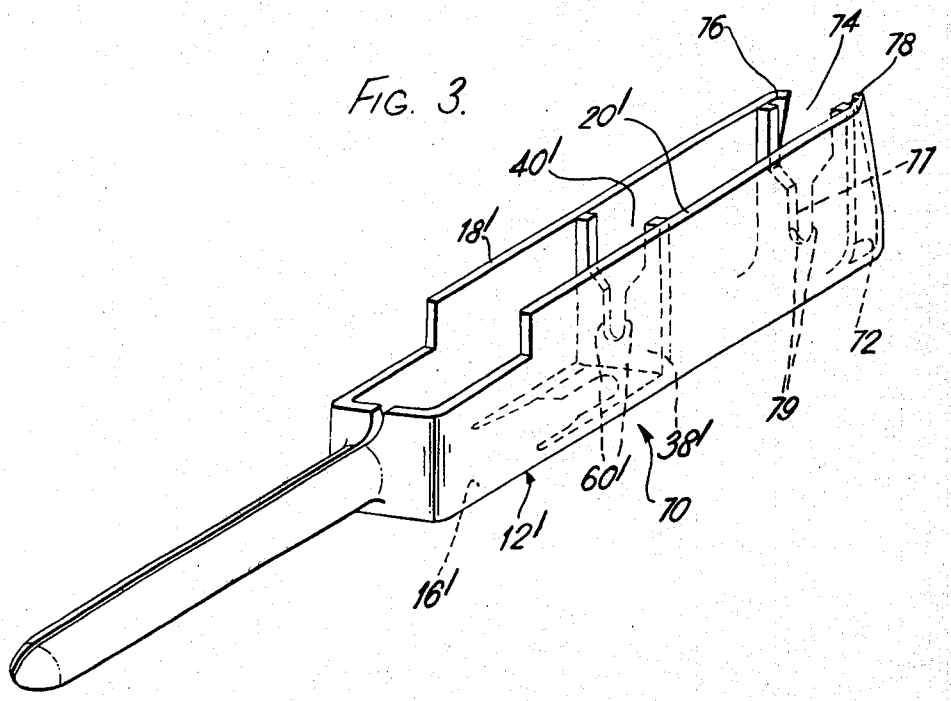
FIG. 3 is an enlarged perspective view of an alternative form of the contact of the present invention.
Figure 4:
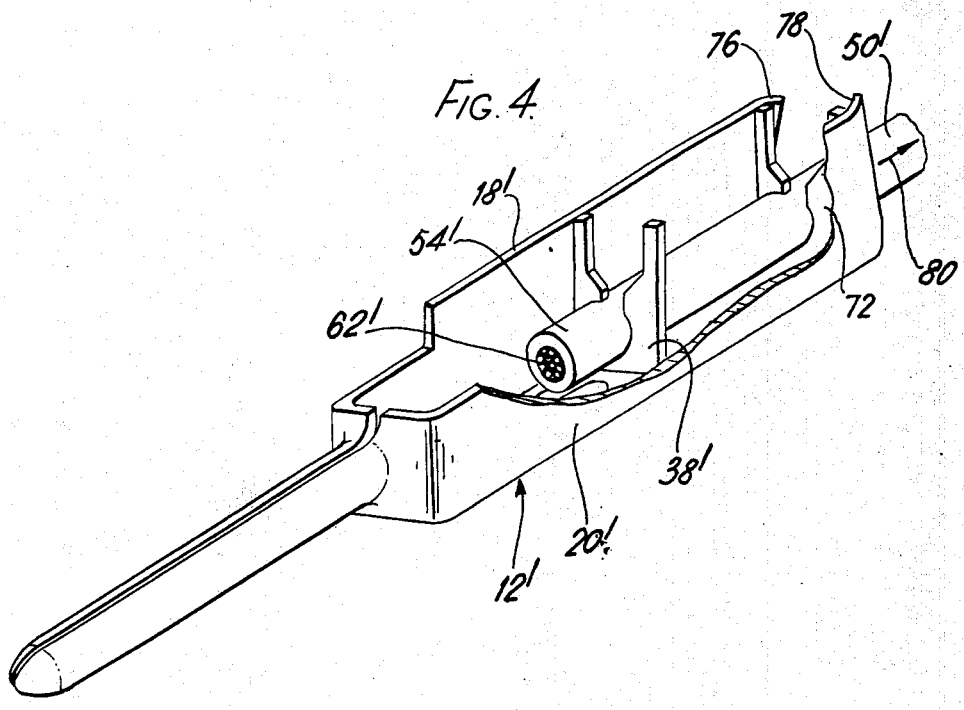
FIG. 4 is an enlarged perspective view of the contact illustrated in FIG. 3 showing a cable terminated thereto, with a portion of the wall of the contact removed to show how the cable is connected to the contact.

Reference is now made to FIGS. 3 and 4 of the drawings which illustrate the second embodiment of the contact of the present invention, generally designated 70. In this embodiment the basic structure is as previously described with respect to the contact 10 and like numbers primed are used to indicate like or corresponding parts. As can be seen, the contact 70 includes a fork 38' identical to the fork 38 and is formed from the base 16' of the contact in the same manner as previously described herein. However, the contact 70 includes a second fork 72 in its rear part behind the fork 38'. The fork 72 has a U-shaped internal opening 74 similar to that in the fork 38'. Fork 72 is bent vertically at a right angle with respect to the base 16' of the contact. Thus, the forks 38' and 74 are parallel to each other and are disposed at right angles with respect to the lateral walls 18' and 20' of the contact. It is noted that the rear ends 76 and 78 of the walls 18' and 20', respectively, are bent inwardly toward the inside of the contact behind the fork 72. No tongus 26, 28 and 30 are provided in this embodiment of the contact of the present invention. The upper part of the opening 74 between the branches of the fork 72 has the same width as the upper part 40' of the opening in the fork 38'. The lower part 77 of the opening in the fork 72 defines a pair of opposed insulation severing jaws 79 which are spaced apart greater than the diameter of the core 62' of the cable 50' but less than the diameter of the insulation sheath 54' of the cable. Thus, the jaws 79 are spaced apart a distance slightly greater than the jaws 60' of the fork 38'.

As in the embodiment illustrated in FIGS. 1 and 2, in this embodiment the cable 50' is terminated to the fork 38' to make electrical connection to the core 62' of the cable when the cable is forced downwardly into the channel-shaped rear part 12' of the contact. However, it is to be noted that the jaws 79 of the fork 72 penetrate only the insulation sheath 54' of the cable and do not penetrate the cable core 62'. The jaws 79 thereby provide a strain relief function for the cable which is performed by the tongues 26, 28 and 30 in the contact 10 illustrated in FIGS. 1 and 2. If the cable 50' is subjected to withdrawal forces in the direction of the arrow 80 in FIG. 4, such forces act upon both the forks 38' and 72. Because the fork 72 abuts the bent over rear ends 76 and 78 of the lateral walls, such withdrawal forces are absorbed by these ends and the forks remain vertical between the walls 18' and 20'.

From the foregoing, it is seen that present invention provides an inexpensive one piece contact structure which allows reliable, high quality electrical termination to an electrical cable due to the positioning of the insulation piercing-core penetrating fork branches between the lateral walls of the rear part of the contact. Furthermore, simultaneously with the cutting of the fork which forms the jaws, there is also formed a resilient retention finger in the base of the contact which serves to releasably retain the contact in a connector insulator. Thus, only a single cutting operation is required to form two important functional parts of the contact. In addition, the contact of the present invention provides effective strain relief for the cable behind the core penetrating jaws of the contact.

What is claimed is:

1. An electrical contact for making electrical connection to a cable core without stripping the insulation sheath from the core comprising:

a front contacting part and a rear part;

said rear part including a flat base;

stripless cable connection means comprising a fork cut from said base and bent upwardly therefrom, said fork including a pair of spaced branches defining opposed insulation-severing core penetrating jaws; and an outwardly bent rearwardly extending contact retention tongue cut from said base and having a configuration complementary to the opening defined between said branches of said fork, said tongue lying within said opening prior to bending said fork upwardly from said base whereby said tongue and fork may be formed by a single cutting operation.

2. An electrical contact for making electrical connection to a cable core without stripping the insulation sheath from the core comprising:

a front contacting part and a rear channel-shaped part having a generally U-shaped cross-section;

said rear part including a base and a pair of lateral walls;

stripless cable connection means comprising a fork cut from said base and bent upwardly therefrom between said lateral walls, said fork including a pair of spaced branches defining opposed insulation-severing, core penetrating jaws, said walls restricting spreading of said jaws when a cable is forced therebetween;

strain relief means integrally formed on said rear part behind said fork, said strain relief means comprising a second fork at the rear of said rear part folded upwardly from said base and disposed generally parallel to said first fork, said forks being generally vertical with respect to said base, said second fork including a pair of spaced branches defining opposed insulation severing jaws, said insulation severing jaws being spaced apart further than said core penetrating jaws for severing the insulation sheath of a cable without necessarily penetrating the core thereof when a cable is forced between said two pairs of jaws; and the rear ends of said lateral walls being bent inwardly behind said second fork to retain said second fork in its vertical position when a cable is pulled rearwardly in the contact.

3. An electrical contact for making electrical connection to a cable core without stripping the insulation sheath from the core comprising:

a front contacting part and a rear channel-shaped part having a generally U-shaped cross-section;

said rear part including a base and a pair of lateral walls;

stripless cable connection means comprising a fork cut from said base and bent upwardly therefrom between said lateral walls, said fork including a pair of spaced branches defining opposed insulation-severing, core penetrating jaws, said walls restricting spreading of said jaws when a cable is forced therebetween; and an outwardly bent rearwardly extending contact retention tongue cut from said base and having a configuration complementary to the opening defined between said branches of said fork, said tongue lying within said opening prior to bending said fork upwardly between said walls whereby said tongue and fork may be formed by a single cutting operation.

* * * * *